United States Patent [19]

Northrup

[11] Patent Number: 4,832,085

[45] Date of Patent: May 23, 1989

[54] VARIABLE-SIZED ROD HANDWEAVING FRAME

[76] Inventor: Marianna J. Northrup, P.O. Box 74, Carpenter Rd., Townville, Pa. 16360

[21] Appl. No.: 265,938

[22] Filed: Nov. 2, 1988

[51] Int. Cl.[4] ..... D03D 29/00

[52] U.S. Cl. ..... 139/34; 28/152

[58] Field of Search ..... 28/149, 150, 151, 152; 139/29, 34

[56] References Cited

U.S. PATENT DOCUMENTS

| | | | |
|---|---|---|---|
| 700,636 | 7/1901 | Foster . | |
| 703,815 | 6/1902 | Painter . | |
| 735,177 | 2/1903 | Truesdell . | |
| 748,120 | 5/1903 | Todd . | |
| 2,011,916 | 11/1935 | Simonds . | |
| 2,159,265 | 2/1939 | Gash . | |
| 2,177,981 | 8/1939 | Haglund . | |
| 2,186,692 | 10/1940 | Boyer . | |
| 2,199,515 | 11/1940 | Woods . | |
| 2,244,085 | 6/1941 | Schneidewendt | 28/151 |
| 2,433,307 | 1/1947 | Thomas . | |
| 2,780,854 | 2/1957 | Dritz . | |
| 3,996,969 | 12/1976 | McCullough . | |
| 4,046,171 | 9/1977 | Wilson . | |
| 4,416,040 | 11/1983 | Towsley | 28/152 |

*Primary Examiner*—Henry S. Jaudon

[57] ABSTRACT

A handweaving system with detachable, variable-sized, flush rod sides, comprised of individual rods connectable together with threaded studs to achieve varying lengths and widths. The rod sides attach to same-plane corner supports in a manner that simultaneously provides working space for the hands and weaving fiber around the rod sides and forms an unobstructed inside angle where the rod sides meet. When used with a technique of weaving known as SunWeaving, the smooth rod surface of this handweaving frame produces a versatile, functional looped edge that borders the entire woven article. In addition to variable dimensions, the handweaving system adapts to a variety of weaving fiber sizes, gauges, handweaving techniques, and applications.

15 Claims, 4 Drawing Sheets

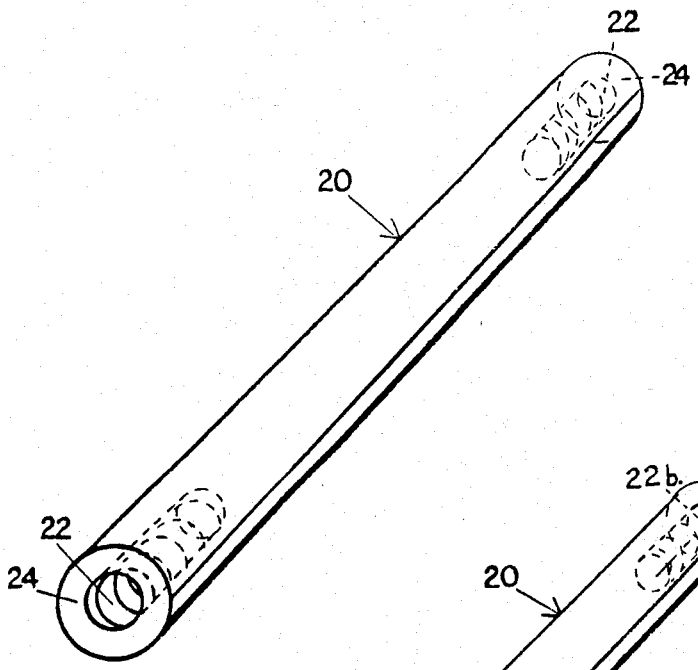
FIG. 1
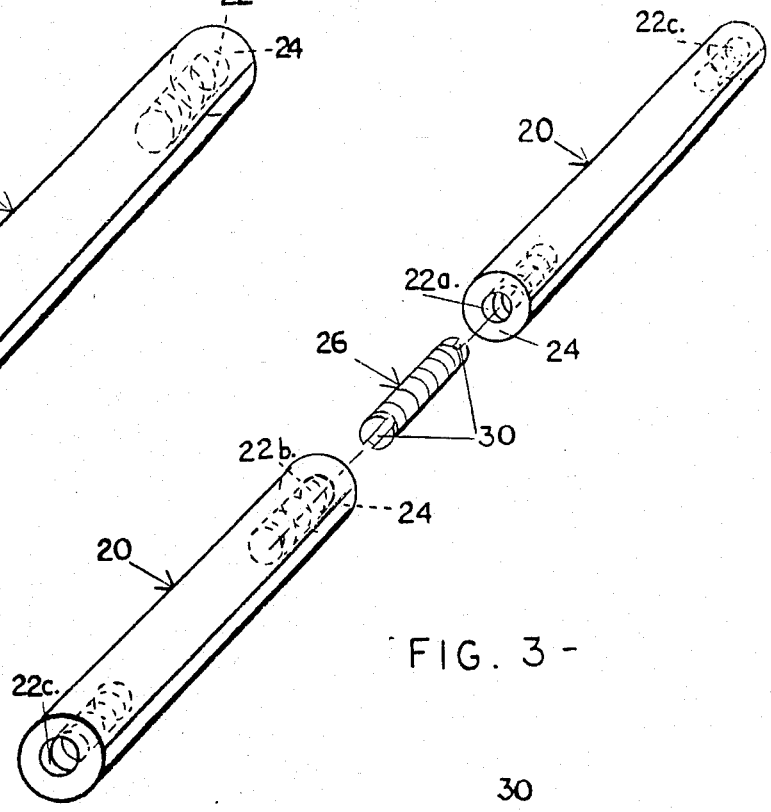
FIG. 3
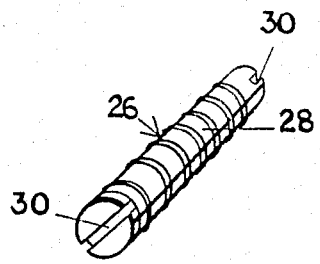
FIG. 2
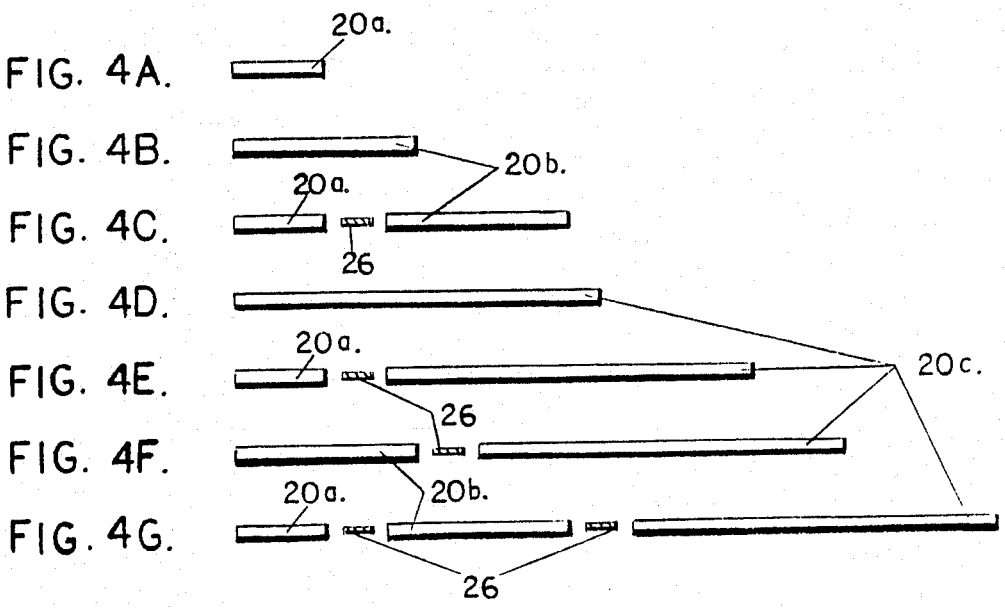

VARIABLE-SIZED ROD HANDWEAVING FRAME

BACKGROUND—FIELD OF INVENTION

This invention relates to handweaving frames, specifically to a variable-sized rod frame for a method of handweaving known as SunWeaving and for other handweaving techniques.

BACKGROUND—DISCUSSION OF PRIOR ART

Weaving, as a hobby, has not been able to achieve the popularity in numbers that knitting and many other needlecrafts have. A primary reason for this lack of interest is the absence of an inexpensive and versatile handweaving tool capable of producing a variety of useful items on a wide range of skill levels. Furthermore, it is unlikely that hobbyists want to develop the designing, machining, and other technical skills necessary to produce a handweaving tool when other needlecraft tools are available and affordable. Thus, a handweaving art-craft void is perpetuated.

A publication entitled "SunWeaving" by Marianna Jackson Northrup, Copyright 1986, describes a technique whereby a body of weaving is attached to small rods for support, forming loops that are secured to the rods with crocheted stitches. This results in an attractive, functional border of crocheted stitches and fiber loops that entirely surrounds the woven fabric to form a finished edge that requires no further attention for single pieces. These loops can also be used to join one woven piece to others. Joining weavings vastly increases the versatility of this invention by combining the ease of weaving small units with the convenience of creating items as large as desired. Additionally, yarn, cord, rope, leather, wire, wooden rods, and other materials can be inserted into these versatile loops to gather or hang the woven piece. A waistline of a skirt, top of a handbag, wallhanging, and ends of a hammock are all examples of additional uses for loops.

Heretofore, prior art limited handweavers in at least five important areas. These areas are the finished size of the woven article, fabric gauge, edge appearance and utility, accommodation of a variety of weaving fibers, and accommodation of a variety of handweaving techniques.

Regarding the finished size of the woven article, U.S. Pat. Nos. 700,636; 703,815; 748,120; 2,011,916; 2,159,265; 2,177,981; 2,186,692; and 2,199,515 disclosed single-sized, relatively small looms. In fact, the earlier patents were called kindergarten looms, an indication of the level of expertise for which they were designed. The lack of size adjustability of these small, single-sized looms produced limitations regarding practical applications.

This present invention provides for custom-sizing by permitting variability in length and width dimensions achievable by the simple interconnection of rods. For example, in the creation of a woven jacket, this invention provides for connecting rods together to form a handweaving frame in dimensions to fit the weaver's size requirements. Furthermore, the front of the jacket can be woven entirely in one piece, or as two halves to be secured with a front fastener, or in various sizes of smaller units to be decoratively joined with contrasting fiber. Prior art particularly lacks this degree of size versatility.

Another important area in which prior art limits weavers is gauge. The gauge of a woven fabric is a reference to the number of rows of weaving fiber in a given unit of measurement. If rows of a given fiber are very close, the result is a stiff, firm fabric. If the same fiber is woven with fewer rows per unit measurement, the resulting fabric is more flexible. In this way, gauge helps to determine the practical application of a woven article. For example, close, stiff weaves are preferable in rugs for obvious reasons, while the draping quality of loose gauges is desirable for clothing.

Most prior art actually eliminated gauge selection. The aforementioned prior art, which consisted of small, single-sized looms, created this shortcoming by using rigidly positioned pins, posts, teeth, combs, notches, nails, holes, and other such gauge-limiting spacing devices for attaching the weaving fiber to the loom. In prior art with adjustable frames, U.S. Pat. Nos. 735,177 had regularly spaced fingers, 2,433,307 used pins arranged in a spaced relation, and U.S. Pat. No. 2,780,854 employed integral, longitudinally spaced teeth, all of which eliminated gauge selection. Gauge in prior art was dictated by the inventor and manufacturer, not determined more appropriately by the weaver and available weaving fiber.

Another shortcoming of spacing devices is that they limit the size of weaving fiber and handweaving techniques that prior art can accommodate due to their unalterable positioning. Yet another disadvantage is that most spacing devices physically project into the work space to impede hand and fiber movement, whereas the smooth shapes and same-plane positioning of exposed members of this invention are designed to facilitate such movement.

This invention is, simply stated, a case of less being better. The unfettered support of this smooth-surfaced, flush rod frame gives the weaver an unlimited gauge selection and freedom of choice in weaving fibers. Woven rows of an extensive variety of fiber sizes can be placed on a rod and secured with crocheted stitches as close together or as far apart as the weaver choses.

Spacing devices are responsible for yet another shortcoming in prior art, one that is related to edge appearance and utility. They create another space in addition to the space between the weaving rows. This other space forms between the peripheral rows of the woven article and the loosely looped edges formed by the fiber wrapped around the spacing devices for weaving support. This space is a counterproductive gap into which peripheral rows slip and cause the body of the weaving to loosen. Furthermore, the edges formed around prior art spacing devices are string-like loops that are unsupported by surrounding fiber, another fact that affects practical application and appearance.

In contrast, this invention enables peripheral rows to be positioned firmly against the finished border of crocheted stitches and fiber loops, preventing any rows from unraveling and distorting the weaving. The looped edges formed by this invention are also a functional part of the woven article, enhancing its finished appearance and increasing the number of practical applications by joining, gathering, or hanging weavings with these versatile loops that remain properly positioned with regard to the weaving rows.

Instead of using rigidly positioned spacing devices as row guides, this invention uses gauge guides to identify row placement that is appropriately based on fiber size and desired gauge. In SunWeaving, an approximate gauge is determined by measuring the width of two threads, or one row, of chosen fiber held together. The weaver can then use this measurement as the gauge or one that is tighter or looser, depending on the intended use of the woven article. Once determined, gauge guides, which are similar to tape measures, provide guidance for rapid, accurate marking of the support frame with a non-staining marker. This is in sharp contrast to the slow, laborious method of using a ruler to measure every row. An even faster alternative is an adhesive-backed gauge guide that is placed directly on the rod frame or support frame to provide instant guidance without any marking.

In the area of accommodating various sizes of fibers with a single handweaving tool, this invention adapts to a wide range of fibers, such as embroidery thread, string, yarn, cord, rope, natural fibers, wire, and others, by using rod members in various diameters. This adaptability further increases its versatility. In fact, this invention gives weavers a choice of two-dimensional sizing, gauge, and fiber combinations that is greater than prior art ever allowed.

In another area of adaptability, other weaving techniques are accommodated by this invention in a number of ways. Handweaving techniques generally require vertical support rows, or warp. Tapestry, one example of an alternate weaving technique capable of use with this invention, normally requires a tedious, time-consuming method of tying each individual warp thread to a frame. By quickly and accurately attaching the warp to the rod frame using SunWeaving loops, the weaver circumvents Tapestry's laborious method of attachment. The weaver can then proceed to weave the horizontal rows, or weft, using Tapestry or other techniques. Furthermore, this invention accommodates the use of shed-producing devices, such as heddles, and other weaving accessories, which most prior art cannot because of the size and gauge limitations described above.

In prior art that is adjustable and has smooth rod sides in one dimension, U.S. Pat. Nos. 3,996,969 and 4,046,171 have shortcomings with regard to weaving width. This particular prior art discloses variable length features, but has rigidly spaced uprights or spaced beams to separate sides, which eliminates a choice in width selection.

SunWeaving's combination of weaving and functional edging techniques has specific frame requirements. Research of prior art, which includes but is not limited to hobby and craft magazines, art and craft supplies, manufactured products in the Thomas Registry, and the patent library, has failed to uncover any frame that meets these requirements.

One invention, specifically, one embodiment of U.S. Pat. No. 2,177,981, discloses a weaving frame with four rods held in the same plane by corner blocks. This prior art has the following shortcomings regarding its use with SunWeaving. Two shortcomings that were already mentioned with other prior art include a lack of size adjustability and, more critically, the creation of weavings with a space between the looped edge and the peripheral rows where woven rows loosen and unravel. This latter drawback is not caused by spacing devices, but rather the design of the corner block and rod attachment. In addition, the tall corner blocks of this prior art hold the four-sided rod frame directly above and close to the support frame, resulting in insufficient room for winding the fiber around the rods with the hands and working the crochet hooks required in SunWeaving. Also, there is nothing that prevents individual rods in this particular prior art from falling out of the open slots in its corner blocks during weaving or storing.

This present invention provides for all of the basic elements of the rod frame and a support frame to be held in the same plane by flat corner members, so as to facilitate, rather than impede, hand and fiber movement. The corner members also distance the rod frame from the support frame to provide the necessary working space around the rod sides. Furthermore, the individual rods are securely fastened to these corner members by a threaded loopholder member to prevent any inconvenient separation of the rods from the support frame while weaving or storing. This same loopholder member attaches to the rods after weaving to prevent fiber loops from prematurely slipping off the rods. This invention provides for an eyelet member to insert fiber through each loop to permanently secure the edging when the weaving is removed from the rods. In addition, tension neutralizing members are provided by this invention to give support to rod sides, particularly small diameter rod sides, to prevent the inward bending that is caused by the tension of the attached weaving fiber. No prior art has this combination of variable-sized all-rod sides, same-plane positioning of the basic elements, unobstructed inside angles where the sides meet, and eyelet and tension neutralizing enhancements as does this invention created for SunWeaving.

With regard to handweaving, nothing exists on the market that approaches the versatility and creative potention of this invention. What this invention provides to a degree that prior art does not is versatility in the important areas of both length and width of article size, of gauge, of combined edge appearance and utility, of accommodation of a variety of weaving materials, of technique variety, and, as the result of the others, of practical applications. Furthermore, the versatility of this invention extends to its use on a wide range of skill levels.

SUMMARY OF INVENTION

This invention relates to a rod frame of variable size for handweaving and, particularly, for a method of handweaving known as SunWeaving. This invention is comprised of a relatively small number of members that often perform multiple functions to minimize complexity for the less skilled user while maximizing versatility for the skilled. Four corner members function to hold a four-sided rod frame squarely and securely to a support frame, with the rod frame, support frame, and corner members all in the same unobstructed plane. The corner members further function to counteract the combined stresses of fiber tension, frame handling, and the weaving process, preventing the rod frame and support frame from twisting out of square. At the same time, these corner members distance the rod frame from the support frame to provide necessary, unimpeded work space to facilitate hand and fiber movement. The corner members also hold the rod sides at a 90-degree inside angle with no intrusion by any frame members into the weaving area, permitting formation of 90-degree woven corners and weavings without gaps between the peripheral rows and the finished edge.

Rod members function as support for the weaving in progress, providing the foundation for the versatile, functional looped edging. The rods possess a tensile strength that resists bending, and have a non-staining, smooth linear surface that allows placement of weaving rows as close together or far apart as desired, without any interference with gauge selection. Rods can be used alone or joined by engaging the female connections at both ends of the rods with double-slotted, threaded male connectors to permit the flush assembly of two or more rods to achieve the weaver's choice of dimensions.

Male-threaded loopholder members initially serve to fasten the rod sides to the corner members. These same loopholder members also function to prevent the woven article from prematurely slipping off the ends of the rods while the rods are being individually disassembled from corner members after weaving.

Tension neutralizing members fit around the rods in the same plane as the other members of this invention, and fasten to the support frame where required to prevent rods from being drawn inward by the tension of the weaving fiber.

Tapelike or adhesive gauge guide members provide a means of rapidly and accurately identifying row placement appropriately related to fiber size and intended use of the woven article.

A male-threaded, needle-like eyelet member replaces loopholder members at one end of each detached rod side. Then, with fiber threaded into the eye, the eyelet travels through each loop as the rods are drawn from the loops. This sequential insertion of fiber thread into the loops by the eyelet permanently prevents the looped border from loosening or unraveling.

No claims are made in this application regarding a support frame for this invention. In the preferred embodiment, this rod-frame invention uses low-cost, easily obtainable artist's canvas stretcher frames as support frames. The availability of these inexpensive stretcher frames in a wide variety of sizes further complements this invention.

The main object of this invention is to provide a handweaving system for a technique known as Sun-Weaving, having a four-sided, variable-sized, loop-holding rod frame with space to work around the smooth, flush rod sides and with no intrusion by any frame member into the weaving area to allow close proximity of peripheral rows to the finished edge, preventing the loosening of either.

Other objects of this invention in accordance with the main object are to provide a means for guiding individual row positioning based on fiber size and desired gauge; to provide a means for preventing the rod weaving frame from being bent inwardly by weaving fiber tension; to provide a means for preventing edge loops from prematurely dislodging from rods during removal of finished weaving from frame; and to provide a reliable means for permanently securing the looped edge with inserted fiber and without missing a single loop as they are removed from the rod.

Another object in accordance with the main object of this invention is to provide a rod handweaving frame capable of producing a functional edge of fiber loops and crocheted stitches that requires no further attention to appear finished as a single piece and can be also used to join, gather, and hang weavings.

Another object of this invention is to provide one handweaving system whose simplicity permits ease of use and lack of mechanical intimidation for the unskilled and simultaneous choices in both length and width dimensions, in gauge size, in weaving materials, in handweaving techniques, and in a wide variety of practical applications for all users.

Other objects of this invention in accordance with the preceding objects is to provide a handweaving tool that conforms to conventional, economical forms of manufacture; to provide a tool that is marketable in small, affordable, expandable units to meet the user's needs; and to provide a tool that is easy to assemble and disassemble, handle, transport, and store.

The final object of this invention is to provide a handweaving system that offers hobbyists and craftspersons the art-craft option of weaving to enjoy.

These together with other objects will become apparent upon consideration of the construction and use embodied in the drawings, and the related descriptions and claims that follow.

BRIEF DESCRIPTION OF DRAWINGS

FIG. 1 is a perspective view of a typical rod member with threaded female connections at both ends in accordance with the preferred embodiment of this invention.

FIG. 2 is a perspective view of a typical male connector member with a threaded body and slots at both ends, for use with the rod member of FIG. 1.

FIG. 3 is a perspective view illustrating the method of interconnecting the rod members of FIG. 1 by using the male connector member of FIG. 2.

FIGS. 4A-B are exploded plan views of the seven different side lengths possible by using one three-inch, one six-inch, and one twelve-inch rod members of FIG. 1, with male connector members of FIG. 2 where necessary.

DESCRIPTION OF PREFERRED EMBODIMENT

Figure 5:
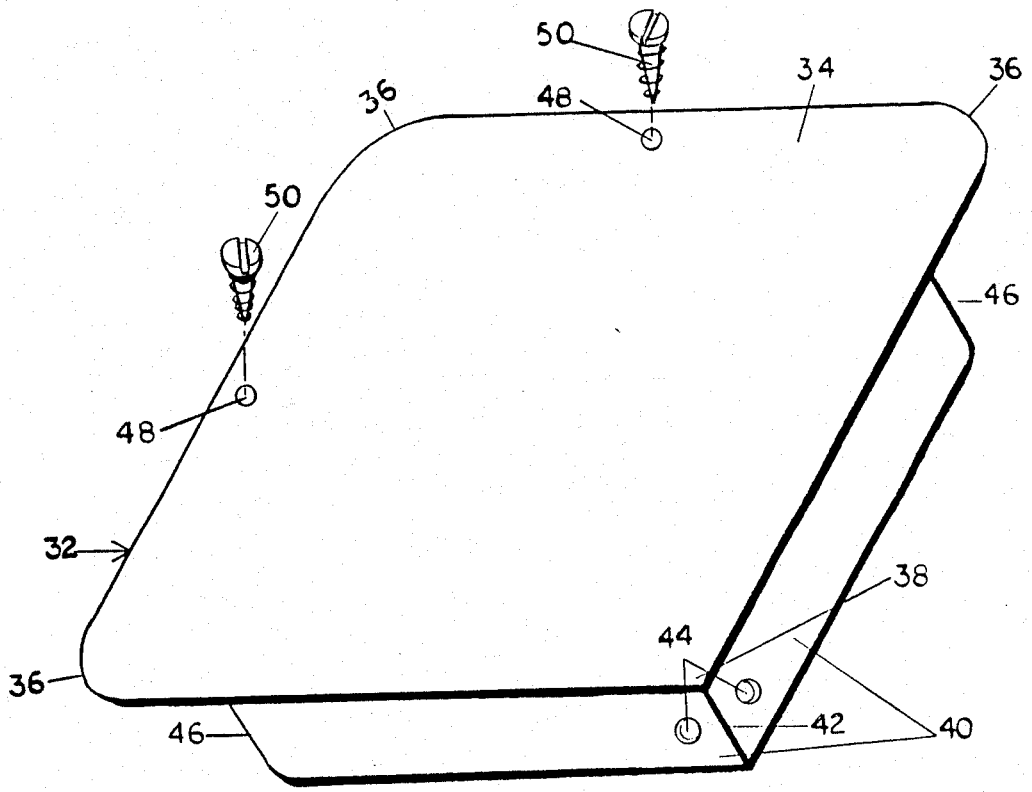
FIG. 5 is a perspective view of a typical corner member in accordance with the preferred embodiment of this invention.

Referring to the drawings, FIG. 1 shows a typical, cylindrical rod member 20 with a smooth surface and internally threaded holes, or female connections 22, at both flat, square ends 24, employable in the preferred embodiment of this invention. Stainless steel rod is the preferred material for rod members because it possesses superior tensile strength that resists bending, and is smooth and non-straining.

FIG. 2 shows a typical double-slotted, threaded male connector member 26 used for assembling two or more rod members together for the purpose of lengthening the sides of the rod frame of this invention. The male connector member is threaded the entire length of the male body 28 and has slots 30 at both ends.

FIG. 3 illustrates the mechanics of interconnecting rod members 20. The length of a male connector member 26 is approximately twice the depth of female connections 22 of the rod members. A male connector member is threaded to one-half of its length into one female connection 22*a*. of a first rod. One female connection 22*b*. of a second rod is then threaded onto the other end of the male connector member until the flat, square ends 24 of the two rod members meet. A smooth, flush linear weaving surface results regardless of the number of rods connected per side. The slope of the threads of the male connector members engage the slope of the threads of the female connections of rod members in a fit that is loose enough to allow assembly and disassembly of rod sides with only the occasional use of a screwdriver, but binding enough so that the sides remains assembled and rigid during use. FIG. 3 also shows that, after the desired side length is achieved, unengaged female connections 22*c*. remain at both outside ends of the assembled rod side. If, when disassembling rod sides, a male connector member resists removal from either of two previously connected rod members, a screwdriver applied to the slot 30 of the exposed end will remove the male connector member.

In FIGS. 4A–G, various single and multiple rod lengths illustrate how only three rods members, one each of the preferred three-inch 20*a*., six-inch 20*b*., and twelve-inches 20*c*. lengths, can form seven different side lengths ranging from three inches to twenty-one inches in three inch increments, using male connector members 26 where necessary. FIG. 4A shows a side length of three inches; FIG. 4B, six inches; FIG. 4C, nine inches; FIG. 4D, twelve inches; FIG. 4E, fifteen inches; FIG. 4F, eighteen inches; and FIG. 4G, twenty-one inches. With one additional twelve-inch 20*c*. length per side, four rods can form eleven different side lengths, from three inches to thirty-three inches. A practical marketing approach could offer a starter unit consisting of four each of the preferred three-inch 20*a*., six-inch 20*b*., and twelve-inch 20*c*. lengths, expandable with one or more units containing four twelve-inch 20*c*. lengths. Sizing by three inch increments generally accommodates most weaving needs, but the three preferred lengths illustrated in FIG. 4A–G represent only the preferred embodiment, and rod lengths can be sized to accommodate the marketplace.

FIG. 5 is an illustration of one of four identical corner members that are employed in the preferred embodiment of this invention. Each corner member 32 has a flat horizontal surface 34 with three rounded corners 36 and one ninety degree corner 38, and has two flat, vertical surfaces 40 that meet at a ninety degree angle to form a vertical edge 42. Each vertical surface has a hole 44 and a back vertical edge 46. The flat horizontal surface has two holes 48 and two fasteners 50. In actual practice, a corner member made of sturdy, non-staining, 20 gauge stainless steel sheeting, with a three and one-half inch square horizontal surface and two vertical surfaces, each one-half inch high and two and one-half inches deep, meets the preferred specifications, provided that all sharp edges and corners are blunted and rounded to protect a weaver's hands and the weaving fiber.

Figure 6:
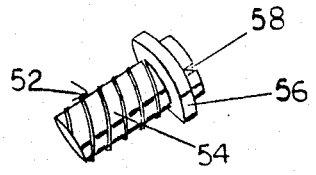
FIG. 6 is a perspective view of a typical loopholder member with a threaded male body at one end and a slotted washerlike head at the other end, capable of use with the corner members of FIG. 5 and the rod members of FIG. 1.

FIG. 6 shows a loopholder member 52 with a threaded male body 54 at one end and a washerlike head 56 with a slot 58 at the other end.

Figure 7:
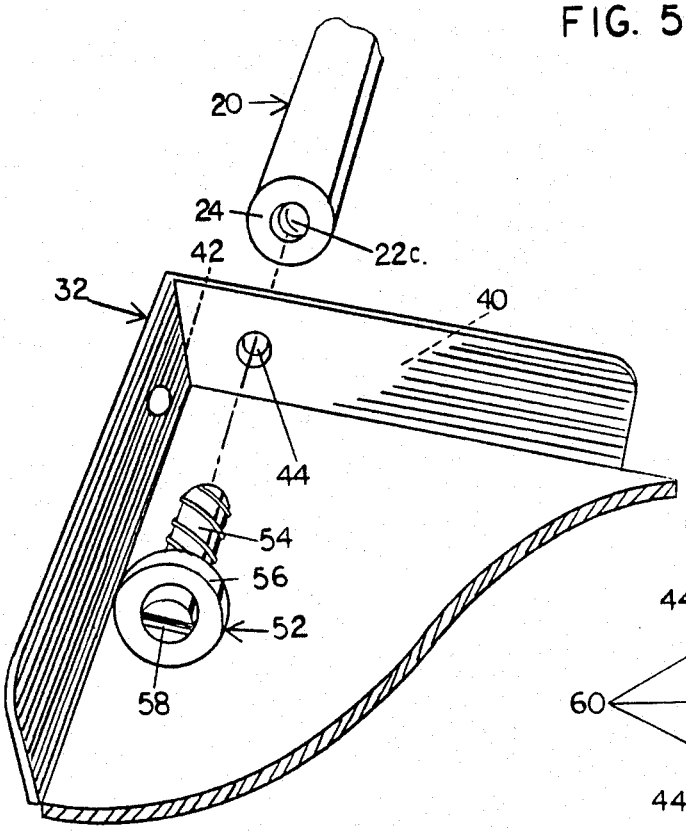
FIG. 7 is a partial perspective view illustrating the method of attaching a rod member of FIG. 1 to a corner member of FIG. 5 with a loopholder member of FIG. 6 in the preferred embodiment of this invention.

FIG. 7 illustrates the method of attaching a rod member 20 to a corner member 32 with a loopholder member 52. The threaded male body 54 of the loopholder member is inserted into the back of the hole 44 in the vertical surface 40 of a corner member until the underside of the washerlike head 56 rests on the back of the vertical surface 40. With the aid of a screwdriver applied to the slot 58 in the washerlike head of the loopholder member, the male body 54 of the loopholder member is threaded into the unengaged female connection 22*c*. and holds the flat, square end 24 of the rod side against the flat, square vertical surface 40 of the corner member. The distance between the vertical edge 42 and the center of the hole 44 in the vertical surface is equal to the radius of the rod member, so that, when assembled, the rod sides will meet in each corner of the rod frame at an unobstructed, ninety degree inside angle without any intrusion of the corner member into the weaving area.

Figure 8:
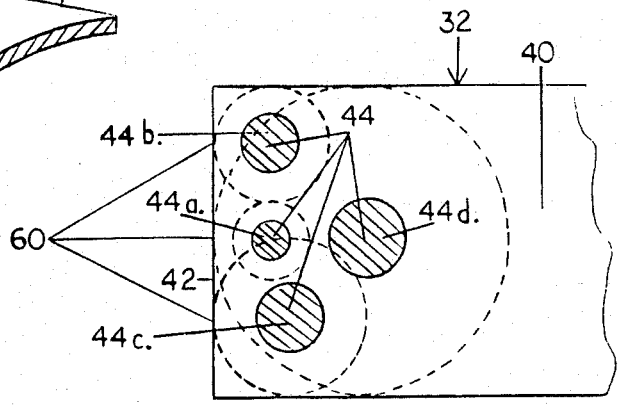
FIG. 8 is a side view of one vertical surface of an alternative embodiment of the corner member of FIG. 5, showing holes for positioning four different rod diameter sizes on one corner member.

FIG. 8 shows an alternative embodiment of a corner member 32 with staggered holes 44 in each vertical surface 40 to accommodate more than one size of rod diameter. The distance between the vertical edge 42 and the center of each hole 44 should be equal to the radius of the rod for which that hole was intended, allowing rods, regardless of diameter, to meet at an unobstructed, ninety degree inside angle without any intrusion of the corner member into the weaving area. This is illustrated in FIG. 8 by the dotted lines 60 that represent the outside circumference of various rod sizes reaching the vertical edge 42 of the corner member where the rod sides meet. For very small diameter rods, such as one-eighth inch, achieving an unobstructed angle at the corners without any intrusion of the corner member may not be practical because, using the radius-to-edge relationship described above, holes for very small diameter rods would be too close to the vertical edge for the corner member to offer support for the rod sides. However, regardless of the size of rod used in SunWeaving, a border of crocheted stitches is formed between the peripheral rows and the loops, and the corner member can intrude into the weaving area a distance equal to the width of this crocheted border without creating the undesirable gap between the peripheral rows in the body of the weaving and the integral crocheted, looped edging. This is particularly important in the positioning of holes for very small rods because it permits sufficient distancing of these holes for the vertical edge of the corner member to provide adequate support. In FIG. 8, the staggered holes 44 in the vertical surface 40 of a corner member 32 illustrate one possible pattern for four common diameters of rods. The smallest hole 44*a*., which is closest to the vertical edge, is for one-eighth inch rod ; the top-most hole 44*b*., three-sixteenths inch rod; the bottom-most hole 44*c*., one-fourth inch rod; and the largest hole 44*d*., one-half inch rod. In practice, one size of rod accommodates a number of different fiber sizes. For example, one-eighth inch handles embroidery thread, string, and fine yarn; three-sixteenths, most other yarn sizes and wire; one-fourth, bulky yarns and cord; and one-half, rope, leather and large natural fibers. Realistically, it only takes four diameter sizes to accommodate a range of weaving fibers that approaches both extremes for handweaving.

Figure 9:
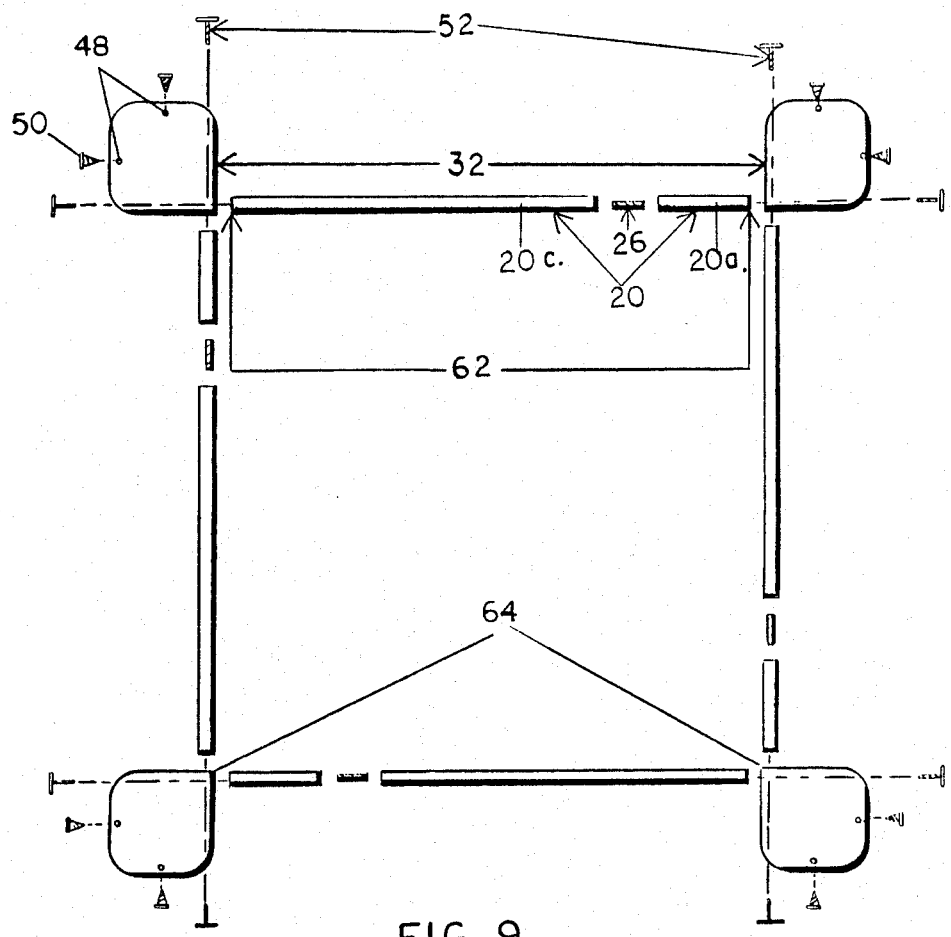
FIG. 9 is an exploded plan view showing the four basic elements of the invention, that of the rod member of FIG. 1, male connector member of FIG. 2, corner member of FIG. 5, and loopholder member of FIG. 6.

FIG. 9 is an exploded plan view showing one possible configuration of this invention, using two rod members 20 per side, one each of three-inch 20*a*. and twelve-inch 20*c*. lengths, to achieve four fifteen-inch rod sides 62 attachable to four corner members 32 with loopholder members 52. This forms a square, same-plane rod frame with unobstructed, inside right angles 64 where the rod sides meet. This assembled rod frame attaches to an appropriately sized support frame by inserting fasteners 50 through holes 48 and into a support frame as shown in FIG. 10.

Figure 10:
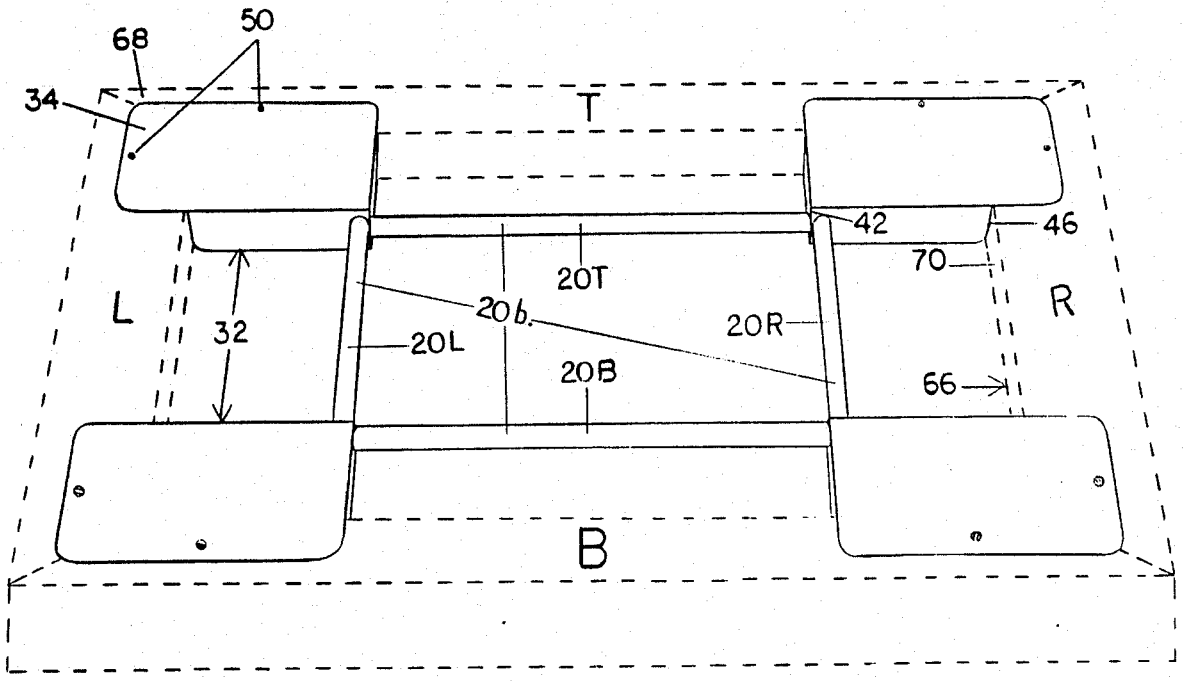
FIG. 10 is a perspective view of this invention assembled with a support frame in the preferred embodiment.

FIG. 10 shows a six-inch 20*b*. rod frame fully assembled and attached to an appropriately sized support frame 66 in the preferred embodiment of this invention. The rod sides form the top 20T, left 20L, bottom 20B, and right 20R sides of the rod frame, with vertical warp fiber to be attached to the top and bottom rod sides, and horizontal weft fiber to be attached to the left and right rod sides. The flat, horizontal surface 34 of the four corner members 32 is attached to the top corners 68 of the support frame by inserting fasteners 50 through holes in the horizontal surface and into the top of the support frame. The back vertical edge 46 of the vertical surface of a corner member rests against the inside vertical side 70 of the support frame. The distance between the back vertical edge 46 and the vertical edge 42 where rod sides meet is the distance that a corner member holds the rod frame from the support frame to provide the necessary working space around the rods.

Figure 11:
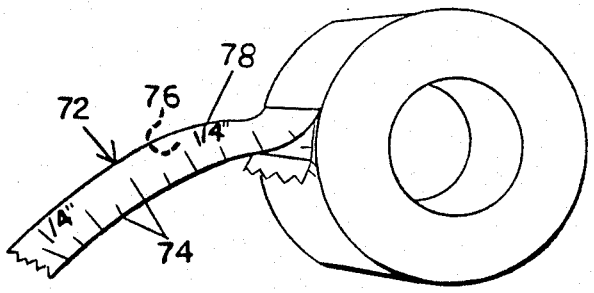
FIG. 11 is a perspective view of a sized gauge guide member with adhesive backing, capable of direct attachment to the rod portion or support portion of the weaving frame of FIG. 10 in the preferred embodiment of this invention.

FIG. 11 shows the preferred embodiment of a gauge guide member 72, which provides instant gauge guidance without physically marking the frames. The appropriate gauge guidance is achieved by attaching a length of the disposable, pre-marked 74, non-stretching gauge member 72 with its adhesive underside 76 directly to rod sides or sides of a support frame. All gauge guide members would be available in a variety of common gauge sizes 78, shown as one-fourth inch in FIG. 11.

Figure 12:
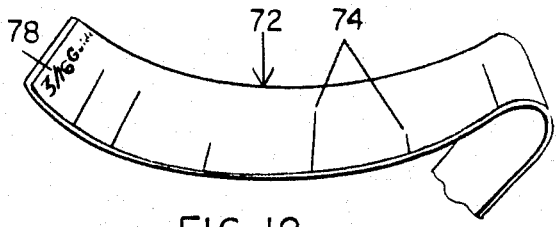
FIG. 12 is an alternative embodiment of a gauge guide member in tapelike form with typical markings to identify row positioning.

FIG. 12 shows a tape-measure embodiment of a gauge guide member 72 in a specific gauge size 78 of 3/16" and with alternating long and short marks 74 to provide row guidance appropriately based on the size of the weaving fiber and desired gauge. After a rod frame is secured to a support frame, a weaver can rapidly and accurately transfer the row positioning marks 74 of the appropriate size of gauge guide to the support frame by using a nail or other non-staining marker.

Figure 13:
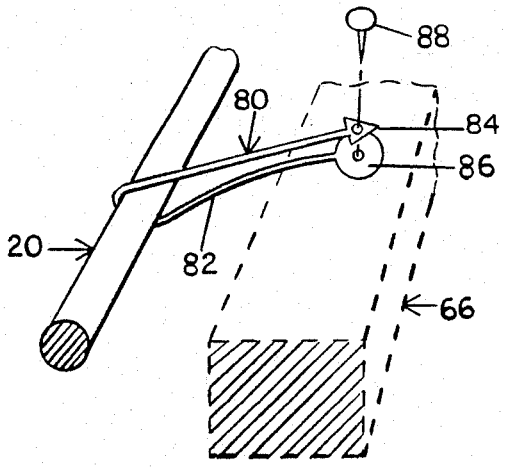
FIG. 13 is a perspective view of a typical tension neutralizing member with a wire body to engage the rod member of FIG. 1, and a head and a rear plate to fasten to a support frame in the preferred embodiment of this invention.

FIG. 13 shows a typical tension neutralizing member 80 that supports rods 20 to prevent inward bending from the tension on the weaving fiber. A thin, wire body 82 wraps around a rod side. The head 84 and rear plate 86 fasten to a support frame 66 with a tack 88 that is inserted through holes in the head and rear plate and into the support frame. The number of tension neutralizing members that is needed depends on the diameter size of the rod frame. For example, a rod frame of relatively small diameter generally requires one tension neutralizing member per foot, that is, one tension neutralizing member in the center of an assembled two foot side. The larger the diameter of the rod members, the greater the resistance to bending, and the smaller number of tension neutralizing members required. FIG. 13 also shows that the tension neutralizing member is in the same plane as the other assembled members. Weaving rows can be placed on either side of the thin wire body without disturbing gauge. After weaving, the removal of a tension neutralizing member is accomplished by detaching the small head 84 from the support frame and slipping it between the loops on the rod and the body of the weaving.

Figure 14:
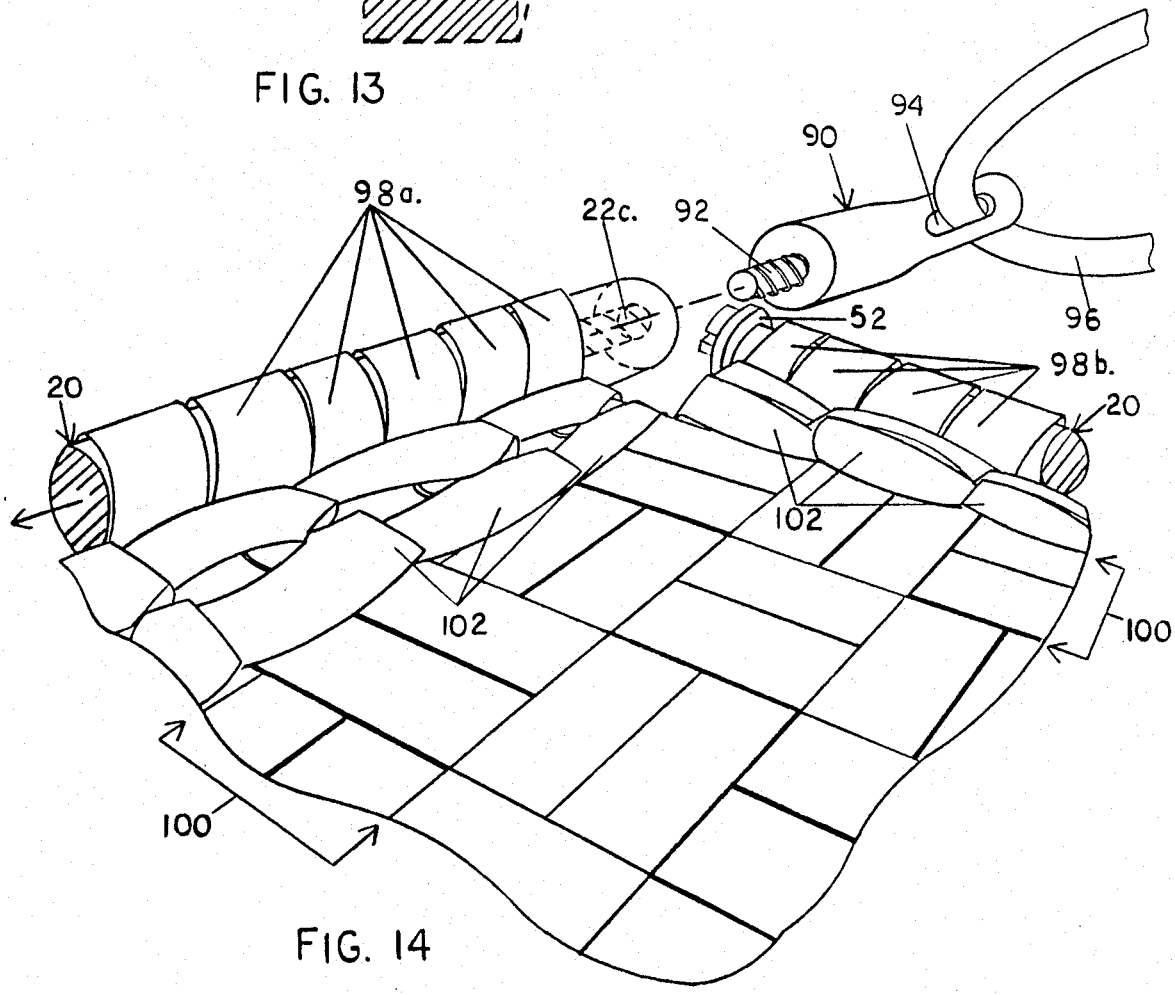
FIG. 14 is a fragmentary perspective view showing an eyelet member with a needlelike hole at one end and a threaded male body at the other end for use with the rod member of FIG. 1 and illustrating the close proximity of peripheral weaving rows to the integral border of crochet stitches and loops in the preferred embodiment of this invention.

FIG. 14 shows an eyelet 90 with a threaded male body 92 at one end and a needle-like hole 94 at the other end. This male eyelet 90 replaces a typical male loopholder member 52 at one end of a detached rod side 22*c*. Then, with weaving fiber 96 threaded into the hole in the eyelet, the eyelet inserts the fiber into the loops 98a as the other end of the rod side to which the eyelet is attached is being drawn out of the loops in the direction of the arrow shown in FIG. 14. This results in the fiber permanently securing the loops from unraveling, and, at the same time, the entire woven piece is removed from the detached rod sides. FIG. 14 also shows a loopholder member 52 positioned beneath the eyelet member in the drawing and attached to the adjacent rod side 20 to prevent loops 98b from prematurely dislodging from the rod. A loopholding member performs two functions. First, it fastens the rod sides to the corner members, forming a four-sided rod frame as shown in FIG. 7, FIG. 9, and FIG. 10. After a weaving is completed, loopholder members are removed to detach the ends of the rod sides from the corner members. Then, to prevent loops, such as 98*b*., of the finished weaving from prematurely slipping off the rod sides and unraveling, loopholder members are temporarily rethreaded back into the ends of detached rod sides. Additionally, FIG. 14 show the critical close proximity of Sun-Weaving's two-threaded peripheral weaving rows 100 to the crocheted stitches 102 and the loops 98*a* and 98*b*.

It is appropriate at this time to discuss the relationship that exists between fiber size and the diameter of the rod frame in the preferred embodiment of this invention, i.e., the fiber size should closely match the rod diameter size. If the diameter of the rod and the diameter of one or two threads of weaving fiber are close in size, then the single or double thread of fiber that is inserted into the loops by the eyelet member will fit snugly and prevent any loosening or movement of the crocheted stitches away from the peripheral rows. However, the variety of applications possible with this invention may cause some deviation from this preferred embodiment. For example, thin string represents one extreme of fiber size, and it would be impractical to use a rod of matching diameter for support purposes. In this case, using a larger diameter rod and inserting thicker fiber into the looped edge with the eyelet member offers one solution. At the other extreme, the size of formed loops needed to insert a wooden rod into the top of a woven wallhanging may require a rod frame of a diameter that is disproportionately larger than the size of the chosen fiber. In this case, a diameter of rod necessary to create large enough loops for a wooden rod might be used at the top while smaller rods, which are more appropriately sized to the fiber, are used elsewhere. There are unlimited variations according to need.

After removing the loops from the rods, the rod sides can be reattached to the corner members on the support frame if more weavings of the same size are desired. If not, the handweaving tool can be disassembled into its individual pieces and stored in a small space. If the support frame is an artist's canvas stretcher frame, it also can be disassembled and stored in very little space.

After completion, woven articles can be joined by various needlecraft techniques, including knitting, crocheting, and sewing, but no description is required here because there techniques are well known. The Sun-Weaving technique, which is a combination of ancient techniques that are also well known, is not described here because this application is for a variable-sized handweaving rod frame invention, not for weaving methods.

It should be apparent that, although this invention, as described, offers considerable versatility and creative freedom regardless of skill level, it need not be limited to the preferred embodiment. For example, an alternative embodiment of a corner member, as described below, would enhance ease of use as follows: loopholder members are threaded directly into the unengaged female connections at the ends of a rod side, leaving a space between the flat, square end of the rod side and the washerlike head of the loopholder member that is slightly larger than the thickness of the vertical side. This loopholder member is then inserted into a slot in the top of the corner member so that the washerlike head falls behind the vertical side to secure the rod to the corner member. The small portion of the exposed male body on the loopholder member acts as a bar that slides into an angled, tapered slot in the vertical side of the corner member, and is held there by the inward tension of the weaving fiber fastened to the rod sides. With the diameter of the male body of a loopholder member varying according to the diameter of the rod to which it is attached, the depth to which a male body, or bar, falls in the tapered slot will also vary, positioning each size of rod with respect to the radius-to-edge relationship. After weaving, hand pressure is applied to push the bar up and out of the angled slot, eliminating the necessity for a screwdriver to attach and detach the rods from the corner members. This quick form of attachment is particularly desirable in an application, as in afghans, where many small units of the same size are woven before the rod frame is disassembled.

Furthermore, an alternative embodiment of a support frame could be provided especially for this invention to enhance purchasing convenience and storage. For example, instead of purchasing several sizes of inexpensive artist's canvas stretcher support frames to accommodate one variable-sized rod frame, the convenience of a single, variable-sized support frame, which complements the size variability of the rod frame by the use of similarly assemblable units, telescoping, or other means, might be sufficiently valuable to the user to justify its expense. Additionally, with a specifically designed support frame, the rod frame need not be limited to four sides.

Separate, inexpensive washers, considerably larger than the washerlike head of a loopholder member, could be provided to keep very large fiber loops from slipping off the detached rod sides until the eyelet member secured them with inserted fiber. Also, the slots in the ends of male connector members and loopholder members, which require the use of a screwdriver, could be altered to accommodate a small hex key, which could be provided with this rod frame.

As another example of alternative handweaving techniques supportable with this invention, exotic, free-form wall art defies categorization as to technique, material, or embodiment. Even non-weaving applications are possible to imagine.

Accordingly, the scope of this invention should not be determine by the embodiments illustrated, but by the appended claims and their legal equivalents.

What I claim is:

1. A rod handweaving frame of variable size comprising:

detachable, flush rod sides comprising individual rod members connectable together, said rod members usable individually or in combination to achieve varying lengths and widths, male connecting means for connecting together said rod members to form said sides with continuously smooth surfaces of varying dimensions, spacing means at each corner for positioning said sides and said spacing means in the same plane and with working space around said sides, and fastening means for attaching said sides to said spacing means so that central working area and inside angles, formed at the point where said sides meet, are free from intrusion by any portion of said rod frame, whereby said variable-sized rod frame is first assembled in desired dimensions and then secured to a support frame.

2. The frame of claim 1 wherein said fastening means attaches directly to the ends of said sides after detachment from said spacing means for preventing premature separation of woven piece from said sides.

3. The frame of claim 2 further including a guidance means for identifying individual row positions based on weaving fiber size and desired gauge, whereby gauge is a function of choice, not structure.

4. The frame of claim 2 further including an eyelet means for preventing looped edging from unraveling by inserting weaving fiber into said edging.

5. The frame of claim 2 further including a means of resistance for preventing said sides from bending inwardly from tension of attached weaving fibers, whereby wrapping of the wire body of said means of resistance around said sides and fastening the two ends of said means of resistance to a support frame will neutralize the fiber tension where required.

6. A variable-sized rod handweaving frame comprising:

detachable, flush, all-rod sides comprising individual rod members connectable together, said rod members having a smooth surface and threaded female connections in both ends for using said rod members individually or in combination to achieve desired lengths and widths, male connecting means for connecting together said rod members to form sides with continuously smooth weaving surfaces of varying dimensions, said male connecting means having threads along its entire length for simultaneously engaging two of said rod members, one on each half, and having slots at both ends for facilitating assembly and disassembly of said male connecting means and said rod members with a screwdriver, spacing means at each corner having a flat, horizontal surface for positioning said sides and said spacing means in the same plane and with working space for weaver's hands and weaving fiber around said sides, and having two flat, vertical surfaces for permitting a close proximity of finished border to peripheral weaving rows that prevents unraveling of either, and fastening means for attaching said sides to said spacing means so that central working area and said inside angles, formed at the point where said sides meet, are free of intrusion by any portion of said rod frame, said fastening means having a slotted, washerlike head at one end and a threaded male body at the other end for fastening the said sides to said spacing means, whereby said rod frame is assembled in desired dimensions, then attached to a support frame.

7. The frame of claim 6 wherein said fastening means attaches directly to the ends of said sides after detachment from said spacing means for preventing premature separation of woven piece from said sides.

8. The frame of claim 7 further including a guidance means for identifying individual weaving row positions based on weaving fiber size and gauge, said guidance means having row positioning marks and an adhesive on the underside of said guidance means for attaching directly to said sides.

9. The frame of claim 7 further including an eyelet means for preventing looped edging from unraveling, said eyelet means having a hole at one end for inserting a thread of weaving fiber and a threaded male body at the other end for fastening to one of the detached ends of said sides to pull fiber through loops as said sides are separated from said loops.

10. The frame of claim 7 further including a means of resistance for preventing said side from bending inwardly from the tension of attached fiber, said means of resistance having a wirelike body that supports said sides where required with same plane positioning of said sides, whereby resistance to bending is provided by fastening the ends of said wirelike body to a support frame.

11. A variable-sized rod handweaving frame for supporting a method of handweaving known as SunWeaving and other handweaving techniques comprising:

four detachable, flush rod sides comprising individual rod members connectable together, said rod members having smooth surfaces and female connections in both ends for using said rod members individually or in combination to achieve a variety of lengths and widths, male connecting means for connecting together said rod members to form said sides with continuously smooth weaving surfaces of varying dimensions, said male connecting means having a threaded surface for inserting one-half of said threaded surface into said female connection at one end of said rod member and the other half of said threaded surface in said female connection of the second of said rod members, and having slots in both ends for facilitating assembly and disassembly of said rod members and said male connecting means by applying a screwdriver to said slot at the exposed end opposite the engaged end of said male connecting member, spacing means at each of four corners for positioning said sides which extend from corner to corner and said spacing means in the same plane and with working space for weaver's hands and weaving fiber around said side, said spacing means having a flat, horizontal surface which prevents said rod frame from twisting out of square, and having two flat, square vertical surfaces for forming four, unobstructed ninety degree angles at the inside corners where said sides meet, whereby close proximity of an integral crocheted and looped border to peripheral warp and weft rows as permitted by said spacing means prevents unraveling of said border and said peripheral rows, and fastening means for attaching said sides to said spacing means so that central weaving area and said inside angles, formed at the point where said sides meet, are free of intrusion by any portion of said rod frame, said fastening means having a slotted, washerlike head at one end for positioning behind a hole in said vertical surface of said spacing member, and having a threaded male body at the other end for inserting through said hole and engaging said female connection at one end of said sides to accomplish positioning of the flat, square end of said side against the flat, square plane of said vertical surface of said spacing means, whereby said rod frame is assembled in a desired size and attached to a supporting apparatus.

12. The frame of claim 11 wherein said fastening means attaches directly to said rod sides after detachment from said spacing means for preventing loops formed around said sides from prematurely slipping off said sides before said loops are premanently secured with inserted fiber to prevent unraveling.

13. The frame of claim 12 further including a guidance means for identifying individual weaving row positions based on weaving fiber size and desired gauge, said guidance means having row positioning marks and an adhesive on the underside of said guidance means for attaching directly to said sides, whereby size of weaving fiber, gauge, and handwoven article is a creative choice offered to a weaver.

14. The frame of claim 12 further includes an eyelet means for permanently securing looped edges to prevent unraveling after said edges are removed from said sides, said eyelet having a needlelike hole at one end for threading with weaving fiber and a threaded male body at the other end for fastening to one of the detached ends of said sides, whereby the action of pulling said eyelet through said looped edges replaces said rod members with said weaving fiber in every loop, in sequence and with errorfree dispatch.

15. The frame of claim 12 further includes a means of resistance for preventing said sides from bending inwardly from the tension of attached fiber, said means of resistance having a wire body supporting said sides where required with same plane positioning of said sides, whereby support is provided by fastening the ends of said means of resistance to a support frame with a tack.

* * * * *